US006687668B2

(12) United States Patent
Kim et al.

(10) Patent No.: US 6,687,668 B2
(45) Date of Patent: Feb. 3, 2004

(54) METHOD FOR IMPROVEMENT OF G.723.1 PROCESSING TIME AND SPEECH QUALITY AND FOR REDUCTION OF BIT RATE IN CELP VOCODER AND CELP VOCOCER USING THE SAME

(75) Inventors: Jeong Jin Kim, Seoul (KR); Kyung A Jang, Seoul (KR); Myung Jin Bae, Seoul (KR); Yoo Na Sung, Seoul (KR); Min Kyu Shim, Seoul (KR); Seong Hoon Hong, Seoul (KR)

(73) Assignee: C & S Technology Co., Ltd., Seoul (KR)

( * ) Notice: Subject to any disclaimer, the term of this patent is extended or adjusted under 35 U.S.C. 154(b) by 407 days.

(21) Appl. No.: 09/749,786

(22) Filed: Dec. 28, 2000

(65) Prior Publication Data

US 2001/0008995 A1 Jul. 19, 2001

(30) Foreign Application Priority Data

Dec. 31, 1999 (KR) ..... 99-68413
Dec. 31, 1999 (KR) ..... 99-68423
Jan. 14, 2000 (KR) ..... 2000-1736
Jan. 14, 2000 (KR) ..... 2000-1750
Jan. 14, 2000 (KR) ..... 2000-1734

(51) Int. Cl.[7] ..... G10L 19/12
(52) U.S. Cl. ..... 704/223; 704/219; 704/222
(58) Field of Search ..... 704/223, 222, 704/221, 220, 219; 709/206

(56) References Cited

U.S. PATENT DOCUMENTS 6,014,689 A * 1/2000 Budge et al. ..... 709/206
6,564,248 B1 * 5/2003 Budge et al. ..... 709/206

* cited by examiner

*Primary Examiner*—Susan McFadden
(74) *Attorney, Agent, or Firm*—Bacon & Thomas, PLLC

(57) ABSTRACT

A method of searching an MP-MLQ fixed codebook through bit predetermination includes the steps of generating a target vector with amplitude, reducing time to search an optimal pulse array through the bit predetermination and searching all of pulses if two errors have an identical value.

4 Claims, 7 Drawing Sheets

METHOD FOR IMPROVEMENT OF G.723.1 PROCESSING TIME AND SPEECH QUALITY AND FOR REDUCTION OF BIT RATE IN CELP VOCODER AND CELP VOCOCER USING THE SAME

BACKGROUND OF THE INVENTION

1. Technical Field

The present invention relates to a CLEP (Code Excited Linear Prediction) voice coder (or, called as vocoder) for improving process time and speech quality of G.723.1 and reducing bit rate.

2. Description of the Prior Art

Generally, CELP (Code Excited Linear Prediction) is a method most broadly used in the vocoder field. This method may obtain good speech quality at about 4.8 kbps bit rate and has been standardized with several standardizing organizations in various applications.

Such method is applicable to an internet phone, a video conference, a voice mail system, a voice pager, etc. and currently TRUE SPEECH and G.723.1 voice coder (called also as "vocoder") are commonly used as a commercial version.

Among them, G.723.1 shown in FIG. 1 has a dual bit rate of 5.3/6.3 kbps, which is used in the internet phone, commercially used as special communication means now, and in a communications vocoder. G.723.1 provides good quality in comparison with its low bit rate. In addition, G.723.1 is more applicable than other vocoder standards because it uses two bit rates for optimized transmission circumstance.

However, because G.723.1 uses an analysis method using composition of the CELP vocoder, which is a manner of separating and then composing components of a voice signal, there is an unavoidable problem of time consumption due to its high computational complex.

In addition, because G.723.1 Dual Bit Rate Speech Codec includes different vocoders, many internal memories and much computational complex are required when realizing it with DSP (Digital Signal Processor) chips. Particularly, because MP-MLQ (Multi Pulse Maximum Likelihood Quantization) mode requires more computational complex than ACELP (Algebraic CELP), the vocoder algorithm which requires less algorithm computational complex to use an inexpensive DSP, is more suitable in the internet phone.

In addition, because, among VAD (Voice Activity Detector) and CNG (Comfortable Noise Generator) used to reduce a bit rate in a voice inactive interval, the VAD uses only energy parameter for final determination of voice activity, there is a drawback that accurate VAD determination is difficult during the energy critical value reaches a current energy level or when SNR is a low signal. Moreover, in fact that G.723.1 vocoder employs a pitch/formant post-filter for improvement of speech quality in a decoding terminal, in which the post-filter uses only the first degree slope compensation filter and the pitch post-filter performs search process under the condition that energy levels are equal in every pitch interval, there is a problem that accurate pitch search is hardly obtained in an interval where the energy level changes.

SUMMARY OF THE INVENTION

The present invention is designed to solve the problem of the prior art. An object of the present invention is to provide a search method, which reduces a processing time of a vocoder by determining GRID BIT of ML-MLQ (Multi Pulse Maximum Likelihood Quantization) in advance.

Another object of the present invention is to provide a search method, which improves speech quality by using a formant post-filter and a pitch post-filter for searching a pitch through energy level standardization as multi-degree slope compensation filters.]

Still another object of the present invention is to provide a search method, which reduces a bit rate in a voice inactive interval by using an algorithm for simply determining a SID (Silence Insertion Descriptor) frame with a ZCR (Zero Crossing Rate) parameter when determining VAD and SID frames having a LSP (Line Spectrum Pair), a pitch gain and energy parameter.

In order to obtain the above object, the present invention suggests a method of searching MP-MLQ fixed codebook through bit predetermination including the steps of generating a target vector with amplitude, reducing time to search an optimal pulse array through the bit predetermination and searching all of pulses if two errors have an identical value; a formant post-filtering method of extracting a reflection coefficient of a slope compensation filter to apply a multi-degree slope compensation thereto; a pitch post-filtering method including an energy level standardization step and a step of generating a signal approximate to an average energy level; a VAD algorithm method using an energy, a pitch gain and a LSP distance; and a method of enhancing a processing time of G.723.1, improving speech quality and reducing a bit rate by using a determination logic algorithm in setting a SID frame for the voice inactive interval, and a CELP vocoder using one of the methods.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Figure 1:
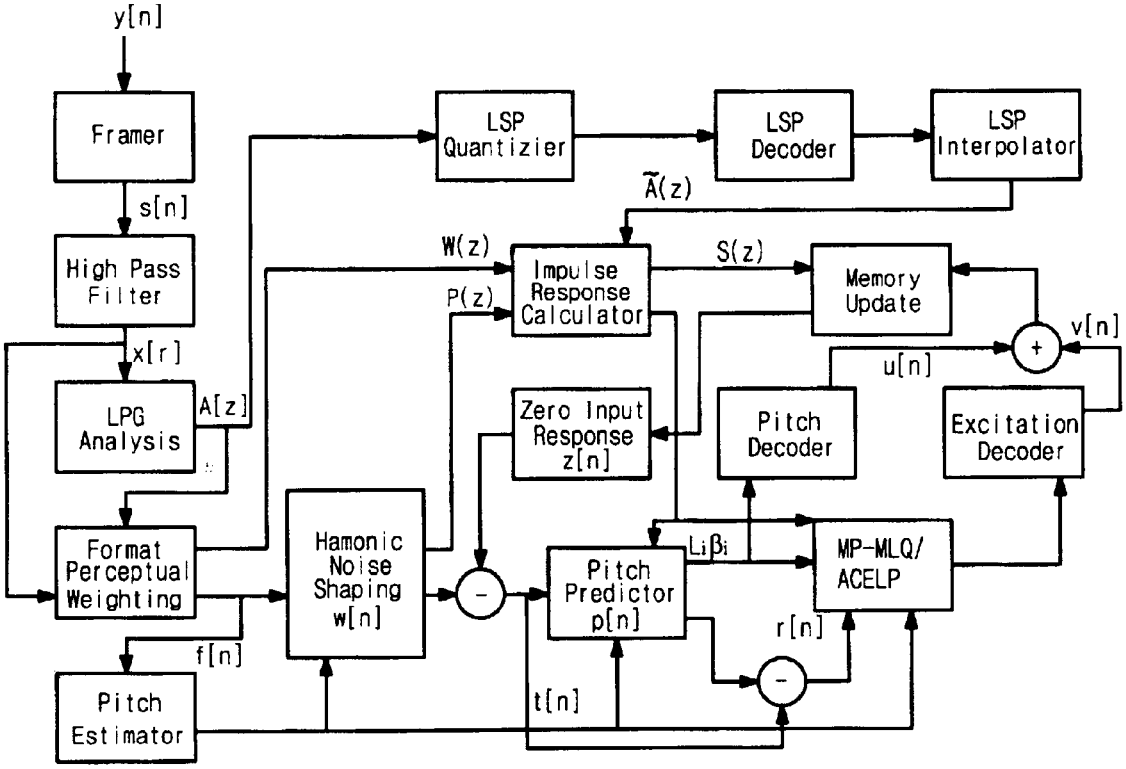
FIG. 1 is a block diagram showing configuration of G.723.1 schematically.
Figure 2:
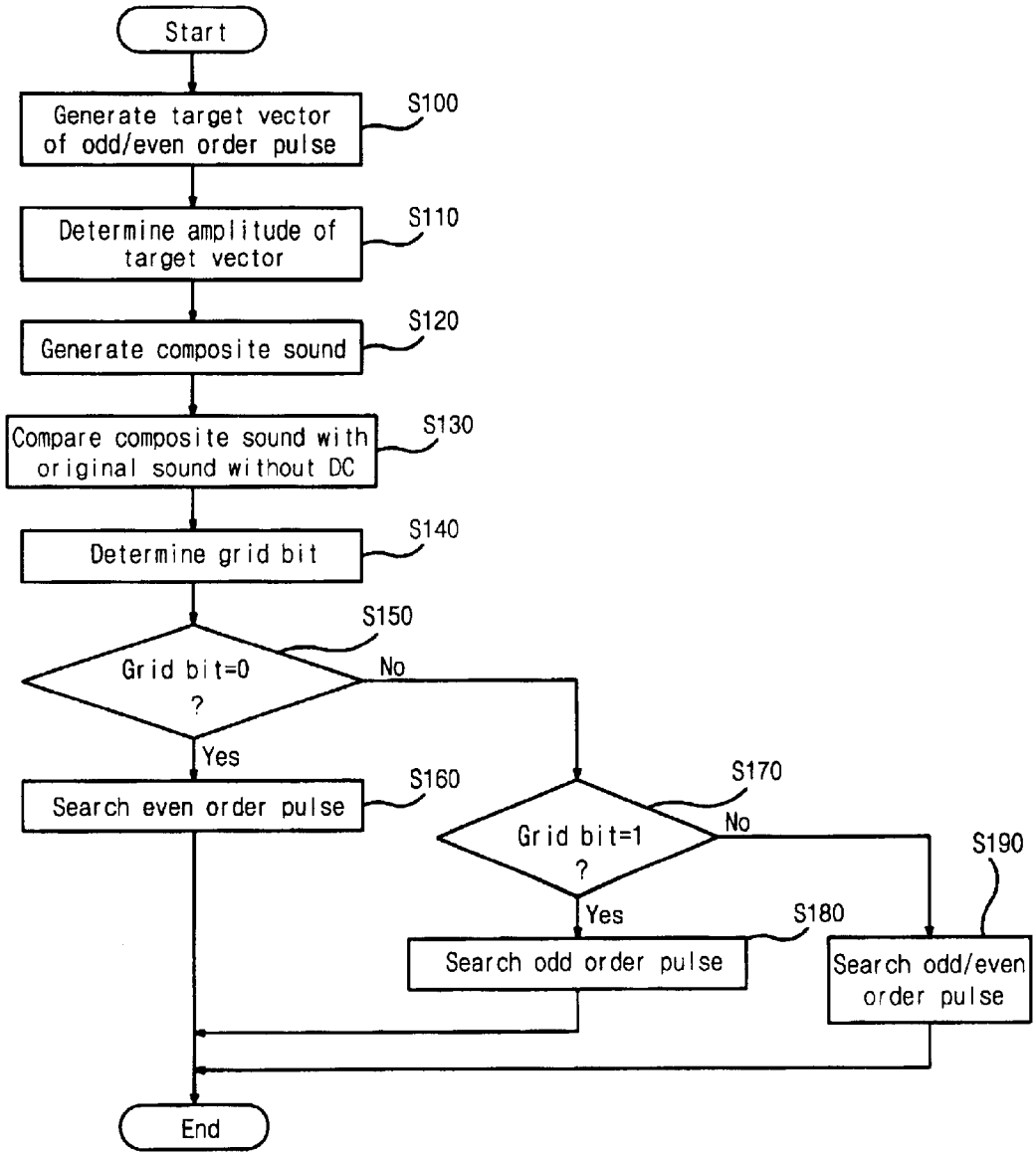
FIG. 2 is a flowchart showing a method for reducing a time required to search a MP-MLQ codebook through grid bit predetermination according to the present invention.

FIG. 2 shows a reduction method of an MP-MLQ codebook search time that predetermines grid bits for predicting the positions pulses during high bit rate decoding of voice signals in a vocoder according to the present invention. As shown in FIG. 2, the method includes the steps of generating a target vector divided into odd/even order pulses S100, determining an amplitude of the target vector S110, generating a composite sound by using the target vector S120, comparing the composite sound with an original sound without DC, determining a grid bit by such comparison S140, checking whether the grid bit is zero S100, searching even order pulses if the grid bit is zero S100, checking whether the grid bit is 1 S100, searching odd order pulses if the grid bit is 1 S100, and checking all of odd/even order pulses if the grid bit is not zero or 1 S100

In the above process, the MP-MLQ codebook search time reduction method by the grid bit predetermination is as follows.

At first, the method executes generation of a target having an odd/even order pulse by using the Equation 1 below.

$$v_i[2\times n+i] = \sum_{n=0}^{\frac{L}{2}-1} r[2\times n+i] \quad i=0,1 \qquad \text{[Equation 1]}$$

Where L is a length of a sub-frame, and i is a parameter to indicate an odd or even number. And, r[2×n+i] means a new target vector.

In addition, $v_i$[2×n+i] means generation of a target vector as for that i=0 and 1, namely, even order and odd order.

An amplitude of the target vector obtained in the above equation is transformed by using the Equation 2, similar to a method in G.723.1.

$$v_i[n] = \begin{cases} +1, & \text{if } v_i[n] > 0 \\ -1, & \text{if } v_i[n] < 0 \\ 0, & \text{otherwise} \end{cases} \qquad \text{[Equation 2]}$$

In the above Equation 2, the amplitudes of the even order pulse target vector and the odd order pulse target vector are ±1, which is set similar to an amplitude of a vector, really transmitted.

The composite sound is composed with the target vector, obtained in the above equation, an impulse response h[n] of S(z) and convolution, which may be seen as the Equation 3 below.

$$s_i'n = \sum_{k=0}^{59} v_i[k]\cdot h[n-k],\ 0 \le n \le 59,\ i=0,1 \qquad \text{[Equation3]}$$

The signal obtained in the above Equation 3 is compared with an original sound without DC. An error signal is derived by adding a difference value of the original sound S[n] and the composite sound $S'_0$ [n], $S'_1$[n] of the even and odd order pulses, which may be expressed as the following Equation 4.

$$err0 = \sum_{n=0}^{59} |s[n] - s_0'[n]| \qquad \text{[Equation 4]}$$

-continued $$err1 = \sum_{n=0}^{59} |s[n] - s_1'[n]|$$

If the original sound, the even or odd order pulse composite sound and the error signal is determined, each error is compared, so determining the grid bit by using the following Equation 5.

$$\text{Grid} = \begin{cases} 0, & \text{if } err0 < err1 \\ 1, & \text{if } err1 < err0 \end{cases} \qquad \text{[Equation 5]}$$

If such condition is not satisfied, all of even/odd pulses are searched, like the MP-MLQ of G.723.1.

If the grid bit is determined in such process, it is determined depending on the grid bit value whether to search even order pulse. That is, if the grid bit is zero, only the even order pulses are searched, while, if the grid bit is 1, only the odd order pulses are searched. Therefore, it may reduce time for search, compared with the prior art.

Figure 3:
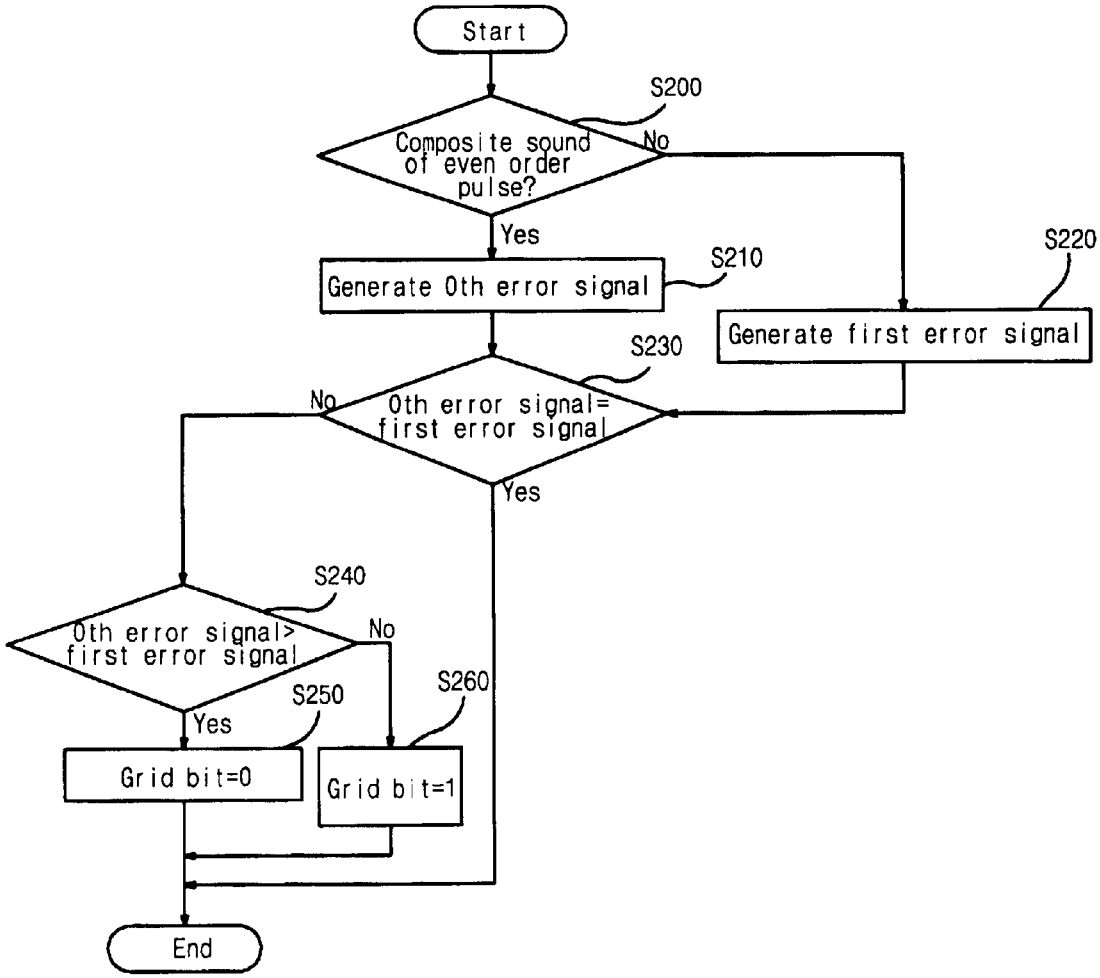
FIG. 3 is a flowchart showing steps of determining the grid bit in FIG. 2.

FIG. 3 is a flowchart for illustrating the step of determining a grid bit in FIG. 2. As shown in FIG. 3, the grid bit determining step includes the steps of checking whether it is an even order pulse composite sound or not S200, generating a $0^{th}$ error signal which is a sum of absolute values of difference signals between a source sound and the even order pulse composite sound if it is an even order pulse composite sound S210, generating a $1^{st}$ error signal which is a sum of absolute values of difference signals between the source sound and an add order composite sound if it is not an even order pulse composite sound S220, checking whether the $0^{th}$ error signal is identical to the $1^{st}$ error signal S230, checking whether the $0^{th}$ error signal has a bigger value than the $1^{st}$ error signal S240, determining the grid bit as zero if the $1^{st}$ error signal has a bigger value than the $0^{th}$ error signal S250, and determining the grid bit as 1 if the $0^{th}$ error signal has a bigger value than the $1^{st}$ error signal S260.

In the above process, the step of determining a grid bit according to the present invention is as follows.

If a composite sound is generated with the Equation 3, even order pulses among 60 samples in a sub-frame of the composite sound add a DC-eliminated source sound and a subtraction-operated absolute value in one sub-frame, so obtaining the $0^{th}$ error signal.

And, odd order pulses among 60 samples in a sub-frame of the composite sound add a DC-eliminated source sound and a subtraction-operated absolute value in one sub-frame, so obtaining the $1^{st}$ error signal.

If the $0^{th}$ error signal and the $1^{st}$ error signal are obtained as above, two error signals are compared each other, whereby the grid bit is determined as 1 if a value of the $0^{th}$ error signal is bigger than that of the $1^{st}$ error signal, while the grid bit is determined as 0 (zero) if a value of the $1^{st}$ error signal is bigger than that of the $0^{th}$ error signal.

The formant post-filter used in G.723.1 employs a first-degree slope compensation filter to improve speech quality. For more improved speech quality, a reflective coefficient of a multi-delay is obtained to compose the slope compensation filter with the coefficient.

Figure 4:
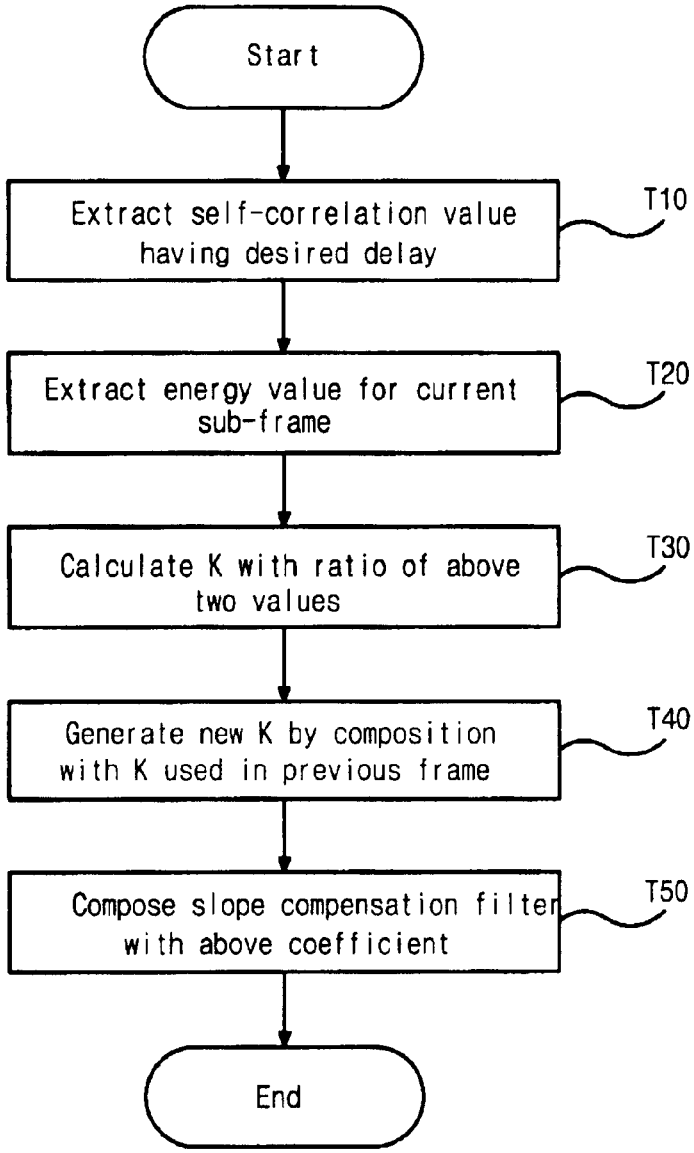
FIG. 4 is a flowchart showing a method of improving speech quality using first-degree slope compensation filter of a formant post-filter according to the present invention.

FIG. 4 is a flowchart for illustrating the method of improving speech quality by using the first-degree slope compensation filter of the formant post-filter employing a multi-degree LPC coefficient. As shown in FIG. 4, the method includes the steps of extracting a self-correlation coefficient having delay as much as desired T10, extracting an energy value for a current sub-frame T20, calculating the self-correlation coefficient by using a ratio between the above two values T30, generating a new self-correlation coefficient by composition with a self-correlation coefficient used in a previous frame to obtain a final self-correlation coefficient to be used in the filter T40, and composing a slope compensation filter having a multi-order reflection coefficient by using the coefficient T50.

The formant post-filter of G.723.1 vocoder is changed with the below Equations 6, 7 and 8.

$$k_d = \frac{\sum_{n=1}^{59} sy[n]sy[n-d]}{\sum_{n=0}^{59} sy[n]sy[n]} \quad \text{[Equation 6]}$$

$$k_j = \frac{3}{4}k_{jold} + \frac{1}{4}k_d \quad \text{[Equation 7]}$$

$$F(z) = \frac{1 - \sum_{i=1}^{10} \tilde{a}_i \lambda_1^i z^{-i}}{1 - \sum_{i=1}^{10} \tilde{a}_i \lambda_1^i z^{-i}} \prod_{j=1}^{m} (1 - 0.25 k_j z^{-1}) \quad \text{[Equation 8]}$$

In the above Equations, a coefficient a is a LPC coefficient decoded in a decoder, having a range between 1 and 10. $\lambda_1$ and $\lambda_2$ have values of 0.65 and 0.75, same as G.723.1 vocoder. A range of j is substituted with a desired order. That is, after calculating a delay of a correlation function till as desired to obtain a numerator value of the Equation 8, k obtained in the previous frame like the Equation 7 is calculated. Here, if a range of j is too increased, excessive filtering may deteriorate speech quality.

Figure 5:
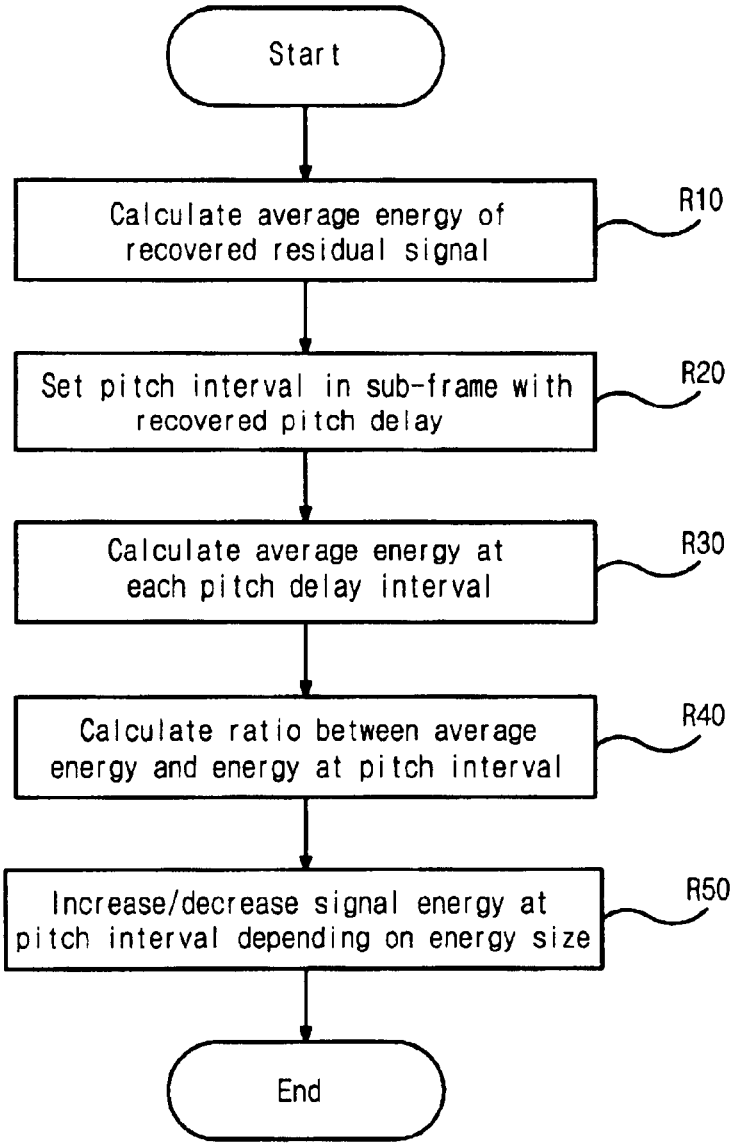
FIG. 5 is a flowchart showing a performance improving method of a pitch post-filter in a voice processing decoder through energy level standardization according to the present invention.

FIG. 5 is a flowchart for illustrating a performance improving method of a pitch post-filter in a voice process decoder through energy level standardization of a residual signal according to the present invention. As shown in FIG. 5, the preprocessing process of adjusting an energy level of a recovered residual signal used as an input of the pitch post-filter in a voice signal processing decoder includes the steps of calculating an average energy of the recovered residual signal R10, setting a pitch interval in a sub-frame by using the recovered pitch delay R20, calculating average energy at each pitch interval R30, calculating a ratio between the average energy and energy in the pitch interval R40, and increasing or decreasing energy of a signal in the pitch interval depending on the energy ratio R50.

Standardization of the energy level is a preprocessing procedure to find more accurate delay value in calculating a pitch delay of the pitch post-filter. This procedure obtains an average energy of residual signals composed in the decoder and adjusts an energy level at each pitch interval on basis of the delay value.

The below Equation 9 is used to obtain an average energy level for residual signals of 120 sample sub-frames.

$$E_{AVE} = \frac{\sum_{n=0}^{119} r[n]^2}{N} \quad \text{[Equation 9]}$$

In which N=120 and r[n] is a residual signal composed in the decoder.

The energy level at each pitch interval is calculated only when the recovered pitch value is less than N, or else the recovered residual signal is used in itself. Formula to obtain the energy level at each pitch is as the below Equation 10.

$$K = \left\lfloor \frac{N}{L_i} \right\rfloor, \text{ if } L_i < N \quad \text{[Equation 10]}$$

$$E_k = \sum_{n=k\times L_i}^{(k\times L_i)+L_i-1} r[n]^2,\ 1 <= k <= K \text{ if } L_i < N$$

Where $\lfloor x \rfloor$ is a maximum integer equal to or less than x, $\{L_i\}_{i=0,2}$ is a pitch delay value of first and third sub-frame among 60 samples. And, an energy level of K+1$^{th}$ interval is obtained using the following Equation 11.

$$E_{K+1} = \frac{\sum_{n=K\times L_i}^{N} (r[n])^2}{N \bmod L_1} \quad \text{[Equation 11]}$$

In the above equation, the denominator employs a residue operation.

After obtaining the energy level at each pitch, a ratio for overall average energy is calculated using the following Equation 12. After that, scaling for each pitch interval is followed. The scaling has a boundary condition between 0.5 and 2.

$$\text{RATIO}_k = \begin{cases} 0.5 & \text{if Ratio}_{k<0.5} \\ \frac{E_k}{E_{AVE}} & 0.5 < \text{Ratio}_{k<2} \\ 2 & \text{if Ratio}_{k>2} \end{cases} \quad \text{[Equation 12]}$$

$$r_k[n] = r_k[n] \times \text{Ratio}_k$$

Where a range of k is $1 \leqq k \leqq K+1$, and $r_k[n]$ is a residual signal at k$^{th}$ interval.

A signal scaled as above is used as an input of a pitch post-filter.

Figure 6:
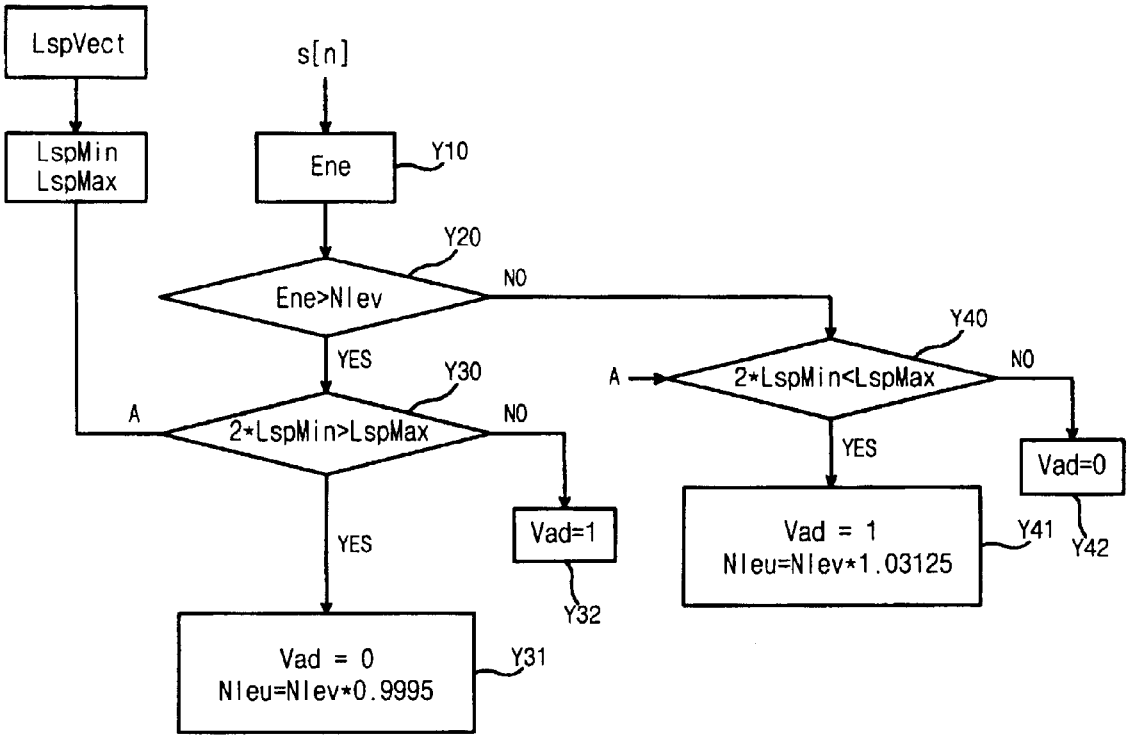
FIG. 6 is a flowchart showing a voice activity detecting algorithm using energy and a LSP parameter.

FIG. 6 is a flowchart for illustrating an algorithm of detecting voice activity using energy and LSP parameter according to the present invention. As shown in FIG. 6, the algorithm includes a first process of calculating an average energy for a frame by voice activity detection Y10, a second process of comparing the calculated average energy with a noise level and then determining as a voiced sound if the average energy is bigger than the noise level while, or else, determining as a voiceless or unvoiced sound Y20, a third process of determining with a minimum value and a maximum value of the LSP interval for considering low SNR (signal-noise ratio) when determined as a voiced sound Y30, and a fourth process of comparing the maximum interval of LSP with the minimum interval for considering low voice energy when the average energy is less than the noise level Y40.

The third process Y30 includes the step of setting the voice activity detection that the formant exists when the LSP minimum interval is bigger than a half of the maximum LSP interval Y31, and or else, determining that the noise has bigger energy, so increasing level of the noise Y32. On the while, the fourth process includes the steps of setting that the voice exists when the minimum LSP interval is less than a half of the maximum interval and then reducing the noise level Y41, and, or else, determining as unvoiced or voiceless Y42.

After assuming that initial 3 frames are unvoiced, the average energy and the average LSP coefficients are obtained using the below Equation 13.

$$Ene_i = \sum_{j=0}^{N-1} s_t^2[n]/N,\ i = 0, 1, 2 \qquad \text{[Equation 13]}$$

$$NLSP_k \sum_{j=0}^{2} LSPvect_k,\ k = 1, 2, \ldots, 10$$

Where N=240, $s_t[n]$ is an input signal of a current frame t, and LSPvect is LSP coefficients obtained in the current frame. By using the above parameters, an energy threshold during first several frames and average LSP coefficients in voiceless intervals are calculated using the following Equations 14 and 15.

$$\text{EneThr=mean(Ene)+1.3×StdDev(Ene)} \qquad \text{[Equation 14]}$$

$$LSPave_k = \frac{NLSP_k}{3},\ k = 1, 2, \ldots, 10 \qquad \text{[Equation 15]}$$

The EneThr obtained above has a boundary value [512, 131072].

In the present invention, there are roughly three determination processes to determine whether the voice exists or not. They are a first case when the energy obtained in the current frame t exceeds the maximum threshold, a second case when the energy obtained in the current frame t does not exceed the energy threshold, and a third case when the energy obtained in the current frame t exceeds the threshold value.

In the above first and second cases, they are determined as a frame where the voice is active and a frame where the voice is not active, respectively. On the while, in the third case, the determination uses a pitch gain and LSP parameters on the consideration of the input signal having low SNR. That is, though the energy exceeds the threshold value, it is determined that the voice exists only when the pitch gain and the LSP interval exceeds their respective threshold, in order to exclude the case caused by noise in the voice inactive interval when the signal has low SNR.

If the energy obtained in the current frame t exceeds the maximum threshold, it is set as a voice active interval regardless of the pitch gain and the LSP interval (VAD=1). In addition, the energy maximum threshold is updated using the Equation 16.

$$\text{EneThr=EneThr}_{t-1}\cdot(1025/1024) \qquad \text{[Equation 16]}$$

If the energy obtained in the current frame t does not exceed the energy threshold, it is set as a voice inactive interval (VAD=0). And, the energy threshold is updated using the following Equation 17.

$$\text{EneThr=EneThr}_{t-1}\cdot(31/32) \qquad \text{[Equation 17]}$$

If the energy obtained in the current frame t exceeds the threshold, the pitch gain and the LSP interval are calculated first.

The pitch gain is obtained using the following Equation 18.

$$\beta_t = \frac{C_{\max}}{Ene_t} \qquad \text{[Equation 18]}$$

Where $C_{max}$ is a value which maximizes $C_b$ in the below Equation 19.

$$C_b = \frac{(Cor(j))^2}{\sum_{n=0}^{N-1} s_t[n-j]\cdot s_t[n-j]},\ 18 <= j <= 142 \qquad \text{[Equation 19]}$$

$$Cor(j) = \sum_{n=0}^{N-1} s_t[n]\cdot s_t[n-j],\ 18 <= j <= 142 \qquad \text{[Equation 20]}$$

The LSP coefficients in a voice inactive interval tend to have same space therebetween, and there is a characteristic that many LSP coefficients exist in a frequency area where the formant is positioned. That is, if obtaining difference between LSP coefficients in the voice inactive interval and LSP coefficients where the voice exists, the value is increased but the difference between the LSP coefficients in the voice inactive interval is significantly decreased. Therefore, it may be determined whether the voice exists or not by using the difference between the LSP coefficients. A distance between the LSP coefficients may be obtained using the below Equation 21.

$$LSPdist = \sqrt{\sum_{i=0}^{10} \{LSP_t(i) - LSPave(i)\}^2} \qquad \text{[Equation 21]}$$

If the pitch gain and the LSPdist value obtained above are less than the predetermined thresholds, it is set as a voice inactive interval, while, or else set as a voice active interval.

$$VAD = \begin{cases} 0, & \text{if } b < bthr \text{ and } LSPdist < LSPThr \\ 1, & \text{otherwise} \end{cases} \qquad \text{[Equation 22]}$$

$$Vcnt = \begin{cases} Vcnt + 2, & \text{if } Ene_t >= Enethr \\ Vcnt - 1, & \text{if } Ene_t < Enethr \end{cases} \qquad \text{[Equation 23]}$$

By using the above Equation 22 and 23, constancy of the determination is maintained.

Though the suggested algorithm is determined as a voice inactive interval, the algorithm may be determined as a voice active interval in order to prevent abrupt change of the determination when Vcnt is more than 0 (zero).

G.723.1 CNG block uses a SID (Silence Insertion Descriptor) frame to decrease bit rate in a voice inactive interval. The frame extracts parameters of new SID frame when the LPC filter in a noise interval changes significantly, compared with the LPC filter of the SID frame, and then transmits the parameters. However, to reduce complexity and its computational amount used for extracting parameters composing the LPC filter, another algorithm is suggested which determines the SID frame by using simple parameters.

Figure 7:
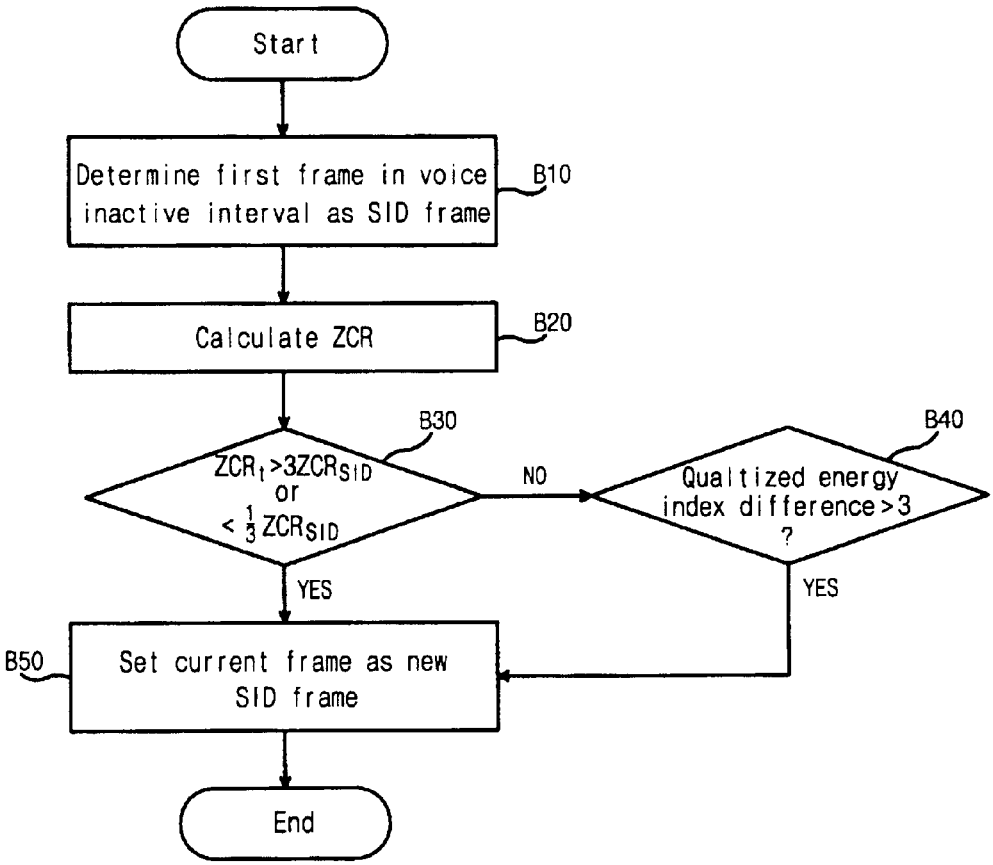
FIG. 7 is a flowchart showing a SID frame determining method of a comfortable noise generator according to the present invention.

FIG. 7 is a flowchart for illustrating a SID frame determining method using energy parameter and ZCR (Zero Crossing Rate) of a comfortable noise generator according to the present invention. As shown in FIG. 7, the algorithm of determining the SID frame includes the steps of determining a first frame in a voice inactive interval shown after the voice active interval as SID (Silence Insertion Descriptor) frame B10, obtaining parameter ZCR (Zero Crossing Rate) extracted from the first voice inactive interval B20, comparing the ZCR with a ZCR in the SID frame, namely, determining whether $ZCR_t$ obtained in the current frame t is more than 3 times or less than ⅓ of of $ZCR_{sid}$ of the SID frame B30, or else, determining by using energy value from COD-CNG of G.723.1 whether an index of quantized energy shows difference more than 3 B40, and, in that case, setting as a new SID frame with determining that the noise signal of the current frame changes B50.

The first frame in the voice inactive interval showing after the voice active interval similar with G.723.1 CNG block is determined with the SID frame and compared with a followed voice inactive interval by using the parameters extracted in the frame.

The parameters extracted in the first voice inactive interval are ZCR (Zero Crossing Rate) and energy. The ZCR is obtained in the frame t with the following Equation 24.

$$ZCR_t = \sum_{m=1}^{239} |sgn[s(m)] - sgn[s(m-1)]| \quad \text{[Equation 24]}$$

$$sgn[s(n)] = 1,\ s(n) \geq 0$$
$$= -1,\ s(n) < 0$$

The ZCR obtained in the Equation 24 is compared with ZCR in the SID frame. If $ZCR_t$ obtained in the current frame is more than 3 times or less than ⅓ of $ZCR_{sid}$, it is determined that the noise signal of the current frame is changed.

The present invention may give an effect of reducing computational complex in real-time realization using DSP chip by searching only one time through bit predetermination, which was conventionally executed two times for even and odd order pulses by using G.723.1 MP-MLQ. In case of the formant post-filter, the speech quality may be improved with low cost by adapting the multi-order slope compensation filter.

In addition, in case of an encoder in the CELP group, more accurate pitch may be calculated, when using signals obtained through the energy level standardization in calculating pitch value and pitch gain composing the pitch filter. Also, by minimizing error with its result, the speech quality may be more improved. Moreover, pretreatment process in the pitch post-filtering of the decoder enables to use more accurate pitch value when periodicity of the signal is emphasized.

Besides, the present invention ensures reduction of transmission ratio by more accurate detection for the voice inactive interval, compared with the voice activity detection device of the conventional G.723.1 to reduce transmission ratio in the voice inactive interval, which will result in increase of users. In addition, the present invention may be used not only as an algorithm for voice inactive interval detection in voice recognition or speaker recognition but also for voice activity detection. In case of CNG, the present invention may be used as an algorithm to determining SID frame only with ZCR and energy parameter, so giving effect of reducing process time.

The according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A method of searching an MP-MLQ (Multi Pulse Maximum Likelihood Quantization) fixed codebook through predetermination of a grid bit for predicting the positions of pulses during high bit rate decoding of voice signals in a CELP (Code Excited Linear Prediction) vocoder, which reduces process time of G.723.1, the method comprising the steps of:

generating a target vector divided into odd order and even order pulses;

determining an amplitude of the target vector;

generating composite sound by using the target vector;

comparing the composite sound with an original sound without DC;

determining a grid bit by the comparison;

checking whether the grid bit is zero;

searching the even order pulses when the grid bit is zero;

checking whether the grid bit is one (1);

searching the odd order pulses when the grid bit is one (1); and searching all of the even and odd order pulses when the grid bit is not zero or one.

2. The method as claimed in claim 1, wherein the amplitude of the target vector is controlled to be the same for even and odd orders.

3. The method as claimed in claim 1, wherein the grid bit determining step compares an error value of each grid bit and then determines the grid bit according to $$\text{Grid} = \begin{cases} 0, \text{ if } err0 < err1 \\ 1, \text{ if } err1 < err0 \end{cases}$$

4. A CELP (Code Excited Linear Prediction) vocoder implemented by the method described in claim 1.

* * * * *